US005418997A

United States Patent [19]

DeFrange

[11] Patent Number: 5,418,997

[45] Date of Patent: May 30, 1995

[54] SANITARY SEWER DEROOTING TOOL

[76] Inventor: Eugene R. DeFrange, 995 W. Jackson St., Krebs, Okla. 74552

[21] Appl. No.: 308,173

[22] Filed: Sep. 19, 1994

[51] Int. Cl.[6] ..... B08B 9/02

[52] U.S. Cl. ..... 15/104.31; 15/104.05; 15/104.095; 15/104.33

[58] Field of Search ..... 15/104.05, 104.09, 104.095, 15/104.31, 104.33

[56] References Cited

U.S. PATENT DOCUMENTS

| | | | |
|---|---|---|---|
| 1,864,617 | 2/1932 | Ree | 15/104.33 |
| 2,192,086 | 2/1936 | Kjerulff | 15/104.30 |
| 2,336,293 | 8/1939 | Pletcher | 15/104.12 |

*Primary Examiner*—Edward L. Roberts, Jr.

*Attorney, Agent, or Firm*—Robert K. Rhea

[57] ABSTRACT

A sanitary sewer root clean out tool for use with a plumber's snake is formed by an elongated helical member having a forward compacted root penetrating end portion supporting a pair of laterally pivoting blades which are retracted during forward movement of the tool and expand laterally in a root cutting action when moved rearwardly. A root cutting assembly transversely surrounds an intermediate portion of the elongated helical member and is angularly rotated thereby by forward and rearward movement of the helical member relative to the cutting assembly to sever roots surrounding the helical member by blades radially projecting outward from the periphery of the helical member as the latter is longitudinally reciprocated.

8 Claims, 2 Drawing Sheets

SANITARY SEWER DEROOTING TOOL

BACKGROUND OF THE INVENTION

1. Field of the Invention

This invention relates to plumber tools and more particularly to a rotary sewer pipe root cutting tool which may be attached to the leading end of plumber snake, or the like.

One of the problems encountered by many homeowner's in residential areas is maintaining the sanitary sewer from the dwelling to its connection with the municipal gathering line free from shade tree and other vegetation roots seeking moisture which tend to obstruct fluid flow through the sanitary sewer line. In order to maintain the sewer line open it is frequently necessary to employ professional help in removing roots from the sewer line.

This invention provides a manually operated economical tool for removing roots from a sewer line.

2. Description of the Prior Art

The most pertinent patent is believed U.S. Pat. No. 2,192,086 issued Feb. 27, 1940 to Kjerulff for PIPE SEWER ROD. This patent discloses a cutter member comprising a plurality of double edge helical blades slidably mounted at respective ends with sleeves surrounding a sewer entering rod. The cutting blades are arcuately bowed outwardly intermediate their ends and the confronting ends of the cutter mounting sleeves are provided with root engaging teeth.

U.S. Pat. No. 1,864,617 issued Jun. 28, 1932 to Ree for SEWER CLEANER and U.S. Pat. No. 2,336,293 issued Dec. 7, 1943 to Pletcher for CLEANING DEVICE are examples of the further state-of-the-art. The Ree patent discloses a pair of semicircular flexible cutting blades intended to follow the inner contour of sewer pipe and the Pletcher patent discloses a plurality of sewer pipe inner wall engaging blades secured at one end portion to a rotating head angularly rotated by fluid pressure from an above ground pump.

This invention is believed distinctive over these and other patents by providing a plurality of sewer root engaging blades projecting outwardly from a body member angularly rotated by an elongated helical member attached to the forward end of a plumber's snake and longitudinally reciprocated manually for rotating the root cutting blade member.

SUMMARY OF THE INVENTION

In one embodiment an elongated helical strap is provided at its forward end portion with a pair of folding root cutting blades which pierce compacted roots when moved in a forward direction and fold outwardly in a root cutting action as the helical member is withdrawn from the root piercing position.

An open end sleeve having a circumferential series of root cutting teeth on each of its end edge surfaces surrounds and is mounted on the helical strap intermediate its ends by a bearing member following the contour of the strap. A pair of arcuately bowed root cutting members are slidably connected at their respective end portions at diametrically opposite positions of the sleeve for angular rotation therewith in a root cutting action outwardly of the periphery of the cylinder member as the helical strap is longitudinally reciprocated relative to the sleeve while contacting sewer pipe roots which angularly rotates the sleeve and its cutting blades between end limits of the helical member.

In another embodiment an elongated helical stiff spring replaces the helical strap and a hexagonal body surrounds the helical spring and is angularly rotated by longitudinal reciprocating movement of the helical spring relative to the hexagonal body when radially outwardly projecting root cutting blades on the hexagonal body are engaged with roots within a sewer pipe.

The principal object of this invention is to provide a clean out device which will adapt itself to variations in the density of roots sewer pipe more readily than other cleaning devices of a similar nature and includes a flexible member which will guide the device round bends in the sewer pipe during the cleaning action.

DESCRIPTION OF THE PREFERRED EMBODIMENTS

Like characters of reference designate like parts in those FIGURES of the drawings in which they occur.

Figure 1:
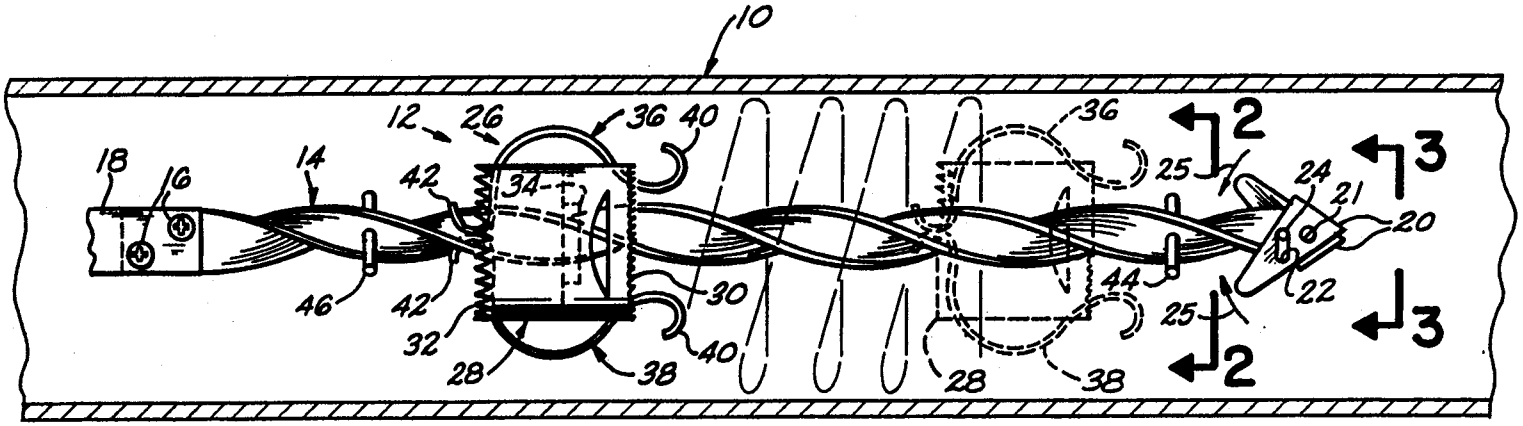
FIG. 1 is a side elevational view of a preferred embodiment of the device in operative position within a fragmentary portion of a sewer line, shown in section and illustrating by dotted lines, angular rotative movement of one component.
Figure 3:
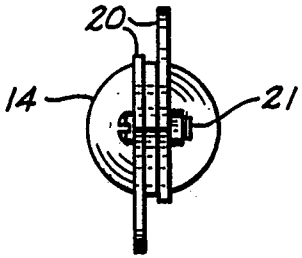
FIG. 3 is an end elevational view looking in the direction of the arrows 3—3 of FIG. 1.
Figure 2:
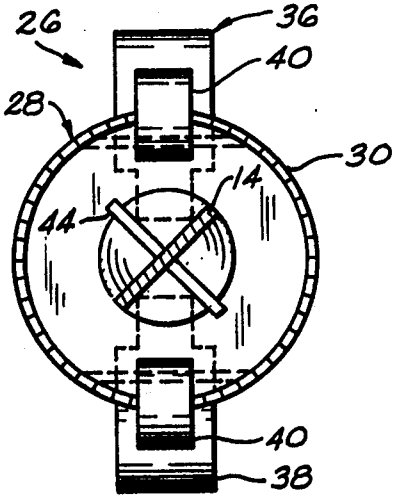
FIG. 2 is a vertical cross sectional view partially in elevation to a larger scale taken substantially along the line 2—2 of FIG. 1.

Referring first to FIGS. 1–3 the reference numeral 10 indicated a conventional sewer pipe assumed to be obstructed by vegetation roots, not shown.

The numeral 12 indicates a preferred form of the device, as a whole, comprising an elongated length of strap metal twisted about its longitudinal axis to form a helical member 14 attached at one end portion, as by screws 16, to the forward end portion of a plumber's snake 18, or the like.

The opposite or forward end of the helical member 14 is provided with a converging end portion having opposite flat surfaces flatly connected with the base end portion a pair of triangular-shaped root cutting blades 20 for pivoting action of the blades about a pivot pin 21. Each of the blades 20 are provided, intermediate their ends, with an arcuate slot 22, only one being shown, for slidably receiving blade pin 24 permitting folding action of the blades, in the direction of the arrows 25, toward and away from the axis of the helical member during forward and rearward movement of the device for the purposes presently explained.

The device is further provided with a root cutting assembly 26 comprising an open end cylinder 28 having a circumferential series of root cutting teeth 30 and 32 formed on its respective forward and rearward end surfaces for the purposes presently explained.

The cylinder 28 is maintained substantially concentric with the axis of the helical member 14 by a cylinder bearing 34, within the sleeve 28, which permits longitudinal sliding movement of the helical member 14 relative to the cutting member 26 as presently explained.

The cutting assembly means is further provided with a pair diametrically opposite sharpened double edge blades 36 and 38 which are arcuately bowed outwardly intermediate their ends and are inserted, at their respective end portions, through cooperating slots formed in the forward and rearward end portions of the sleeve 28. The forward end portion 40 of each of the arcuate blades 36 and 38 are turned arcuately outward and back upon itself and similarly the rearward end portions 42 of each of the arcuate cutter blades contact the opposite surfaces of the helical member 14 and are arcuately turned outwardly in opposing directions.

A pair of rod-like stops 44 and 46 on respective forward and rearward end portions of the helical member 14 limit the forward and rearward movement of the cutter assembly 26 relative to the helical member 14.

Figure 4:
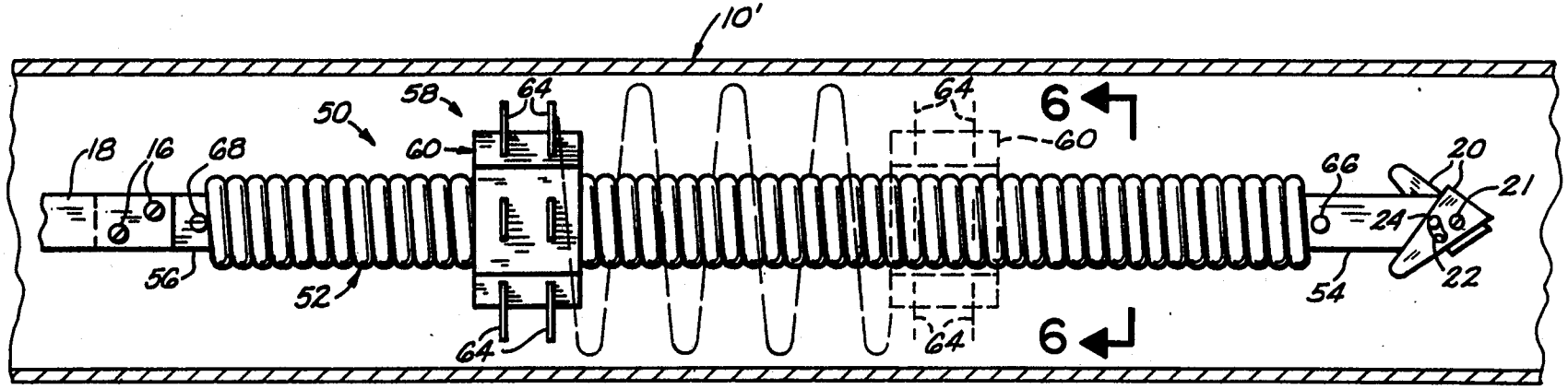
FIG. 4 is a view similar to FIG. 1 of another embodiment.
Figure 6:
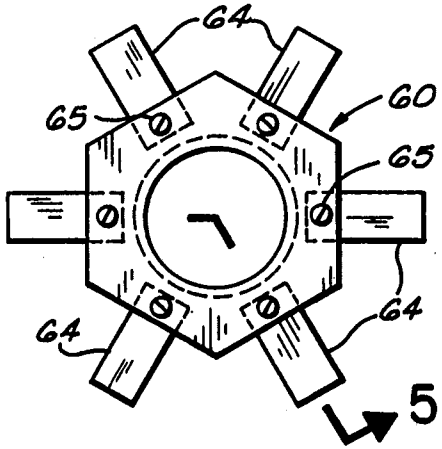
FIG. 6 is a vertical cross sectional view, to a larger scale, taken substantially along the line 6—6 of FIG. 4; and, FIG. 7 is a fragmentary elevational view, to a larger scale, of an alternative blade end portion of the device.
Figure 5:
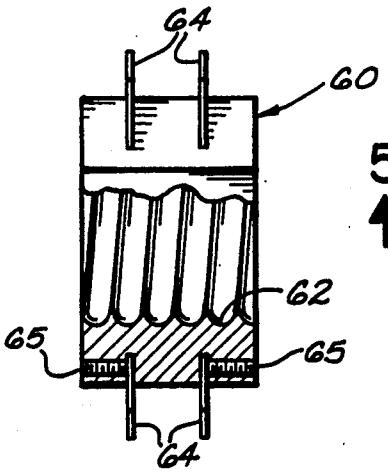
FIG. 5 is a cross sectional view taken substantially along the line 5—5 of FIG. 6, to a larger scale, partially in elevational.

Referring also to FIGS. 4–6 the reference numeral 50 generally indicates an alternative embodiment of the root clean out tool in which the strap metal helical member 14 is replaced by an elongated length of heavy duty stiff helical spring 52 having rigidly connected strap metal end portions 54 and 56 for respective connection with the pair of root cutter blades 20 and the plumber's snake 18.

A hexagonal root cutting assembly means 58 comprises a hexagonal body 60 having a helical thread-like internal bore 62 cooperatively surrounding the helical spring 52 intermediate its ends for angular rotation of the body 60 by longitudinal movement of the spring 52, as hereinafter explained.

The body 60 supports a plurality of pairs six, in the example shown, of radially outward projecting sharpened double edge cutter blades 64 secured by pins 65. Rod-like stops 66 and 68 on the respective strap extensions 54 and 56 of the spring 52 limit the forward and rearward movement of the hexagonal member 60 relative to the spring during root cutting action, as hereinafter explained.

Figure 7:
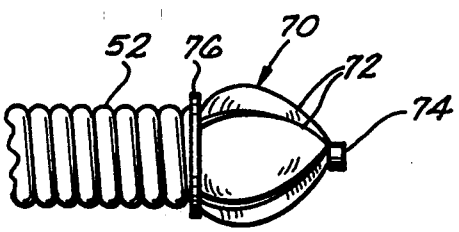

Referring to FIG. 7, the cutter blades 20 and the forward strap metal member 54 may be replaced by a pilot cutter 70 comprising a plurality of park circular sharpened cutting edge blades 72 surrounding and converging toward the forward end portion of a shaft 74 secured to the spring 52 with a washer 76 interposed between the blades and the forward end of the spring form a bearing surface for the blade unit.

Operation

In the preferred embodiment shown by FIGS. 1–3, as the snake 18 moves the clean out tool 12 forwardly within the sewer pipe 10 gravity normally maintains a peripheral portion of the sleeve 28 and/or one of the cutter blades 36 or 38 in contact with the lower most inner surface portion of the pipe 10 or sediment collected thereon.

The cutter assembly 26 is normally positioned adjacent the rearward stop 46 by friction against the inside wall of the pipe or roots, not shown, therein. When the leading end of the tool 12 encounters an entanglement of roots, not shown, such obstruction will be detected by the operator noting the resistance to the snake and the tool.

The operator, after pushing the tool into an entanglement of roots, reverses movement of the snake and tool 12 and pulls it toward the point of pipe entry. Frictional contact of the pair of blades 20 with roots pivots these blades outwardly at their rearward ends opposite the direction of the arrows 25, so that the expanded position of the blades cuts roots encountered during rearward movement of the helical member 14.

During this rearward movement of the helical member 14 if any roots are encountered by the blades 36, 38 and/or the cylinder 28, the rearward movement of the helical member angularly rotates the cutting assembly 28 to sever such roots.

This cycle of operation is repeated by the operator as is necessary to thoroughly loosen and clear roots within the pipe 10 which are then flushed by water downwardly to the municipal collection line, not shown.

The operation of the alternative embodiment shown by FIGS. 4–7 is substantially identical to that described hereinabove with the exception the helical spring 52 is more flexible intermediate its ends than is the helical member 14 and thus may bend around obstructions within the pipe 10 or around a curve or elbow therein.

Obviously the helical member 14 may be formed for lateral flexing of its forward end relative to its rearward end by omitting an intermediate portion of the helical convolutions.

Obviously the invention is susceptible to changes or alterations without defeating its practicability. Therefore, I do not wish to be confined to the preferred embodiment shown in the drawings and described herein.

I claim:

1. A sanitary sewer root clean out tool, comprising:

an elongated helical member having forward and rearward end portions, said rearward end portion adapted to be connected with the sewer entering end portion of a plumbers snake for longitudinal movement therewith in a sewer pipe;

root cutting blades pivotally mounted on the forward end portion of said helical member for movement of the blades between a folded root penetrating position during forward movement of said helical member to a laterally expanded root cutting position during rearward movement of said helical member; and, root cutter assembly means including a generally cylindrical member transversely surrounding an intermediate portion of said helical member for angular rotation about the longitudinal axis of said helical member as the latter is moved longitudinally relative to the cutter assembly means.

2. The root clean out tool according to claim 1 in which the root cutter assembly means further includes:

a plurality of sharpened double edged blades supported by and projecting laterally beyond the peripheral limit of said cylindrical member.

3. The root clean out tool according to claim 2 in which the double edged blades are radially disposed in circumferential spaced relation.

4. The root clean out tool according to claim 2 in which the double edged blades extend longitudinally toward the respective end portions of said helical member, and said cylindrical member comprises a sleeve having root cutting teeth on its respective end edges.

5. The root clean out tool according to claim 3 in which the double edged blades include longitudinally spaced pairs of rigid blades.

6. The root clean out tool according to claim 4 in which the double edged blades includes a pair of diametrically opposite spring steel blades.

7. The root clean out tool according to claim 2 in which the helical member comprises:

a length of strap material, and said cylindrical member comprises a sleeve having root cutting teeth on its respective end edges.

8. The root clean out tool according to claim 2 in which the helical member comprises:

a heavy duty stiff spring normally having adjacent convolutions in contiguous contact.

* * * * *